United States Patent [19]

Attanasio

[11] 4,437,449

[45] Mar. 20, 1984

[54] ARROW PROJECTING HANDBOW

[76] Inventor: Michael P. Attanasio, 1156 Glenwood Blvd., Schenectady, N.Y. 12308

[21] Appl. No.: 281,462

[22] Filed: Jul. 8, 1981

[51] Int. Cl.[3] ..... F41B 7/00

[52] U.S. Cl. ..... 124/22; 124/41 R

[58] Field of Search ..... 124/20 B, 23 R, 24 R, 124/41 A, 87, 88

[56] References Cited

U.S. PATENT DOCUMENTS

| | | | |
|---|---|---|---|
| 1,375,776 | 4/1921 | Buys | 124/20 R |
| 1,847,593 | 3/1932 | Cameron . | |
| 2,625,926 | 1/1953 | Foster | 124/20 R |
| 3,018,770 | 1/1962 | Saunders . | |
| 3,272,193 | 9/1966 | Olecko | 124/20 R |
| 3,306,278 | 2/1967 | Spatari . | |
| 3,455,288 | 7/1969 | Knerr . | |
| 3,517,657 | 6/1970 | Alban . | |
| 3,561,418 | 2/1971 | Fredrickson | 124/24 R |
| 3,901,209 | 8/1975 | Woolsey et al. | 124/20 R |
| 4,026,032 | 5/1977 | Smith | 124/87 X |
| 4,061,125 | 12/1977 | Trotter | 124/24 R |

FOREIGN PATENT DOCUMENTS

| | | | |
|---|---|---|---|
| 1500802 | 10/1967 | France | 124/20 B |

*Primary Examiner*—Richard J. Apley
*Assistant Examiner*—William R. Browne
*Attorney, Agent, or Firm*—Bacon & Thomas

[57] ABSTRACT

An improved handbow for shooting arrows with substantially the same accuracy and power of longbows, wherein the handbow is defined by a frame that includes an opening through which the arrow is supported and shot with the assistance of an adjustable sight, an elastic bowstring secured at its opposite ends to the frame, and a pair of rearwardly projecting stops for terminating the forward movement of the bowstring and providing an even application of force to the arrow. The frame is preferably integrally molded from plastic material and includes a handle with associated grips which are grasped together by the hand of the archer to provide maximum comfort and stability during shooting, particularly when high-powered bowstrings are utilized.

12 Claims, 6 Drawing Figures

ARROW PROJECTING HANDBOW

BACKGROUND OF THE INVENTION

1. Field of the Invention

The present invention generally relates to bows for shooting projectiles, such as arrows and the like. More specifically, the invention deals with handbows of compact size for shooting substantially the same arrows as conventional longbows.

2. Description of the Prior Art

The sport of archery, whether practiced in conjunction with target shooting or hunting, utilizes what is conventionally known as a longbow. This type of bow includes a handle and a pair of flexible limbs extending from either end of the handle to a total length of about 3–5 feet. Because of their size, longbows require special handling considerations, particularly under hunting conditions when the bow is utilized in thick brush or on tree stands of limited space. It is recognized that longbows do provide good accuracy and power, but their necessary large size does create constraints in both use and transportability.

It is clear that if the typical accuracy and power of a longbow can be substantially realized in a more compact structure, then such a device would be highly advantageous as a substitute for its bulky counterpart. The prior art has attempted to fulfill this need through various compact bow structures, known as handbows, which are essentially a combination of the basic concepts inherent in both the longbow and the slingshot. These handbows shoot substantially the same arrows used by longbows, with the projecting force being applied through an elastic bowstring rather than through a pair of flexible limbs.

While heretofore known handbows do provide the advantages of small size and easy transportability, there are certain inevitable disadvantages of handbows because of the difficulty in accommodating all the desired characteristics of a longbow in such a compact structure. Firstly, the accuracy of handbows has generally been compromised because such devices cannot readily accommodate the use of conventional bowsights and the very nature of the required elastic bowstring causes it to snap in an irregular manner and prevent an even application of force to the arrow upon its release therefrom. Secondly, the structural configurations of known handbow frames do not easily accommodate the use of strong or high-powered elastic bowstrings since a secure and stable grip by the archer is generally not possible, thus significantly limiting the shooting power available for handbows.

SUMMARY OF THE INVENTION

The present invention provides an improvved handbow which includes a novel angular frame structure having a handle and associated grips which, when grasped together by the hand of the archer, permits the use of heavy elastic bowstrings having maximum power capabilities. The bowstring is detachably secured in slots disposed at opposite ends of the frame, with the latter being preferably integrally formed of strong lightweight material, such as injection-molded plastic. The frame includes a pair of rearwardly projecting stops which serve to terminate the forward movement of the bowstring to provide an even application of force to the arrow upon its release and promote consistency and accuracy in shooting. The frame is provided with an opening through which the arrow is supported and shot, with an adjustable sight being disposed in the opening to assist in aiming the arrow.

It is an object of the invention to provide an improved handbow which is compact in size and capable of providing substantially the same performance as a conventional longbow.

It is another object of the invention to provide an improved handbow which is capable of using high-powered bowstrings while providing a high degree of shooting accuracy.

It is yet a further object of the invention to provide an improved handbow which is light in weight, strong in structure and economical to manufacture.

These and other objects, features and advantages of the invention will become apparent from the following description of preferred embodiments thereof, with reference to the accompanying drawings which form a part of the specification, wherein like reference characters designate corresponding parts of the several views.

DETAILED DESCRIPTION OF THE PREFERRED EMBODIMENTS

Figure 1:
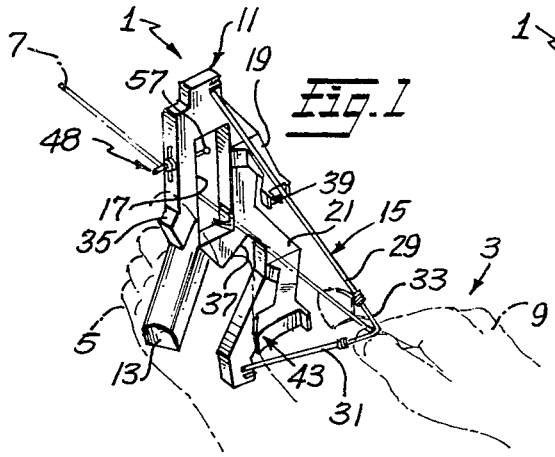
FIG. 1 is a pictorial view of an embodiment of a handbow according to the present invention.

A handbow 1 according to a preferred embodiment of the invention is depicted in FIG. 1. Handbow 1 is shown in a right-hand version wherein an archer 3 grips handbow 1 with his left hand 5, and both draws and releases an arrow 7 with his right hand 9. It is to be understood that a left-hand version of the invention shall be a reversed or mirror image of handbow 1 and shall otherwise be virtually the same from both structural and operational standpoints.

As indicated in FIG. 1, handbow 1 is basically defined by an angular-shaped frame 11 which includes a handle 13 and an elastic bowstring 15. Frame 11 is also provided with an opening 17, preferably having a closed perimeter of rectangular configuration, through which arrow 7 is supported, aimed and shot. Extending rearwardly from frame 11 are a pair of stops 19 and 21 which function to terminate the forward movement of bowstring 15 upon release of arrow 7 therefrom.

Figure 2:
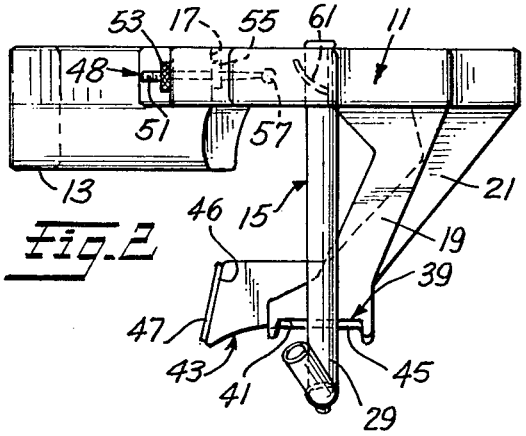
FIG. 2 is a plan view, on an enlarged scale, of the handbow of FIG. 1, with the elastic bowstring being shown in its relaxed state and secured within the corresponding recesses of the rearwardly extending stops.
Figure 4:
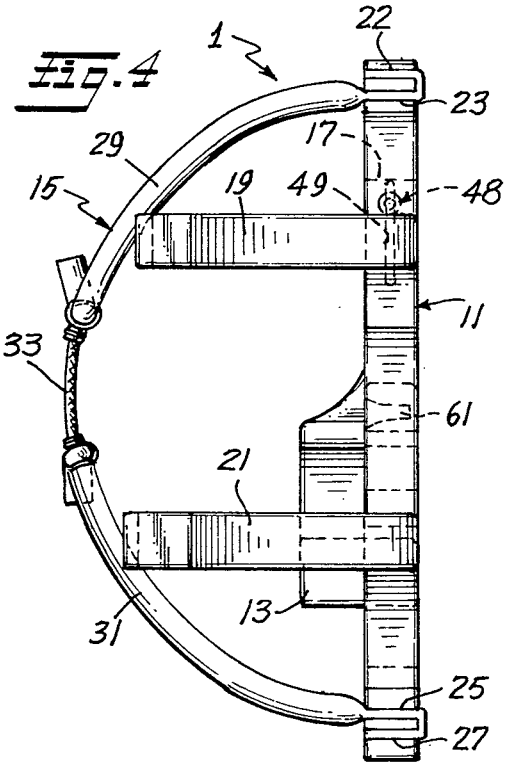
FIG. 4 is a side elevational view as seen from the right side of FIG. 3.
Figure 3:
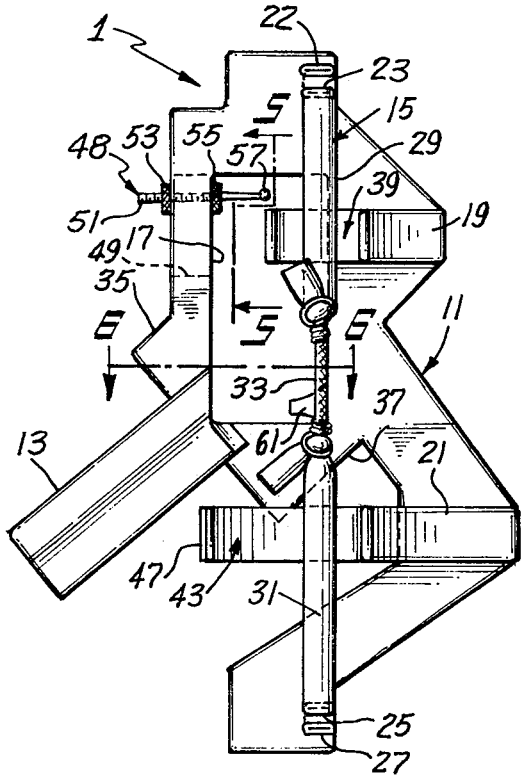
FIG. 3 is an elevational view of the handbow of FIG. 2.

Handbow 1 shall now be described in greater detail with reference to FIGS. 2–4. As shown therein, frame 11 is substantially flat in configuration and includes a pair of upper slots 22,23 and a pair of lower slots 25,27 within which the opposite ends of bowstring 15 are stretched and secured. Bowstring 15 includes an upper elastic cable 29 and a lower elastic cable 31 which are joined together by a tie 33, the latter being preferably inelastic and made from conventional bowstring material as used in a longbow. Cables 29 and 31 are preferably of equal elastic strength and may comprise rubber surgical tubing, flat rubber bands or any other such means well known in the art and deemed suitable for the practice of this invention. Handle 13 extends laterally and downwardly away from frame 11 in its depicted position and is preferably integrally formed with frame 11. A pair of grips 35 and 37 are directly associated with handle 13 for grasping therewith by hand 5 of archer 3 in shooting handbow 1. This is depicted in FIG. 1 wherein hand 5 primarily grasps handle 13 in its palm, with the forefinger engaging grip 35 and the thumb engaging grip 37. In this manner, archer 3 maintains a stable and secure grip on handbow 1 to enhance shooting accuracy while permitting the use of high-powered bowstrings.

Figure 5:
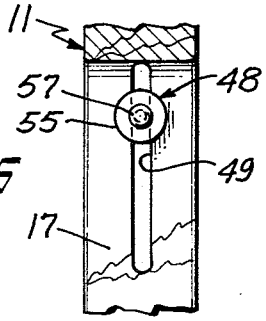
FIG. 5 is an enlarged fragmentary vertical sectional view showing the adjustable sight, taken on the line 5—5 of FIG. 3.
Figure 6:
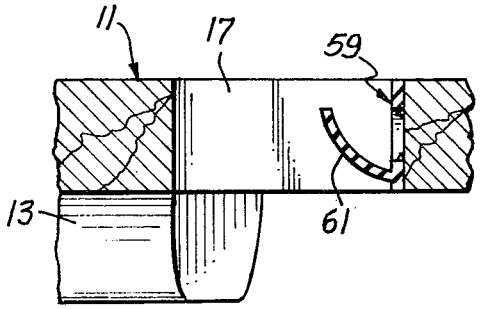
FIG. 6 is a fragmentary horizontal sectional view, showing the arrow rest, taken on the line 6—6 of FIG. 3.

An important aspect of handbow 1 resides in the provision of stops 19 and 21 which are preferably disposed in parallel and extend rearwardly toward archer 3 in the position of shooting as depicted in FIG. 1. Stop 19 terminates in a cup-shaped recess 39 having a substantially planar-shaped bottom 41. Similarly, stop 21 also terminates in a cup-shaped recess 43 having a substantially planar-shaped bottom 45 and a lateral bearing surface 46, the latter serving the function of bearing against the wrist or arm of archer 3 to provide stabilization of handbow 1 during drawing of bowstring 15. Bearing surface 46 may be provided with a suitable padding or cushion 47 to increase comfort during shooting. As more clearly shown in FIG. 4, bottoms 441 and 45 are aligned in a substantially coplanar disposition so that contact of same by corresponding portions of bowstring 15 shall occur substantially simultaneously. As also depicted, tie 33 is disposed approximately midway between bottoms 41 and 45. As generally shown in FIG. 3, and more particularly detailed in FIG. 5, handbow 1 includes an adjustable aiming sight 48 which is secured through a slot 49 provided in frame 11. Sight 48 includes a threaded pin 51 which may be moved horizontally or vertically through appropriate loosening and tightening of an outer nut 53 and an inner nut 55. The innermost end of pin 51 extends into opening 17 and carries a sight bead 57, the use of which is well known in the art. As is apparent, the disposition of sight 48 prevents its interference with or contact by bowstring 15, with the forward movement of the latter being terminated by stops 19 and 21 well ahead of sight 48. As also shown in FIG. 6, opening 17 is provided with an appropriate arrow rest 59 which includes a flexible lip 61 for supporting arrow 7 during aiming and shooting of handbow 1.

As previously mentioned, it is highly preferable that frame 11 and handle 13 of handbow 1 be integrally formed in one piece from strong lightweight material. This can easily be accomplished by injection molding molten plastic or die casting aluminum in a mold having the desired configuration. Frame 11 may also be cut or carved from any suitable wood which is capable of withstanding the stresses imposed during shooting, particularly at those areas adjacent the base of handle 13, end connections of bowstring 15, and stops 19 and 21. By forming frame 11 in this integral manner, shooting comfort and transportability of handbow 1 are significantly enhanced, with the overall structural strength of handbow 1 being such as to permit the use of very strong or high-powered elastic bowstrings for maximum power capability.

The shooting of handbow 1 as depicted in FIG. 1 is accomplished by archer 3 grasping handle 13 in the palm of left hand 5 and engaging grip 35 and grip 37 with, respectively, the index finger and thumb of hand 5. Bearing surface 46 is pressed against the wrist or arm of hand 5 to stabilize handbow 1 during drawing of bowstring 15. Arrow 7 is nocked in tie 33 of bowstring 15 and supported through opening 17 on lip 61. By grasping the nocked end of arrow 7 at tie 33 with his thumb and index finger of right hand 9, archer 3 may then draw arrow 7 and bowstring 15 rearwardly for shooting. Alternatively, arrow 7 and bowstring 15 may be drawn by archer 3 using his index and middle finger in the manner of shooting a conventional longbow. Maximum accuracy is assured by utilizing bead 57 of sight 48 for aiming arrow 7 in a manner that is well known in the art.

Upon release of arrow 7, bowstring 15 immediately snaps forward and abruptly contacts opposed bottoms 41 and 45 of, respectively, stops 19 and 21. At this point, arrow 7 is released from tie 33 and shoots forward through opening 17. Because of stops 19 and 21, bowstring 15 is prevented from snapping wildly in an irregular manner, thereby providing a uniform application of force to the arrow upon its release and promoting consistent accuracy in shooting. As shown in FIG. 4, stops 19 and 21 preferably extend rearwardly to a distance which is just sufficient for bowstring 15 to contact the outer edges of bottoms 41 and 45 while in a relaxed state. The provision of stops 19 and 21 prevent damaging contact between bowstring 15 and both sight 48 and arrow rest 59, as well as painful contact between bowstring 15 and hand 5 of archer 3.

It is to be understood that the forms of the invention herein shown and described are to be taken as preferred embodiments of the same, and that various changes in shape, material, size and arrangement of parts may be restored to without departing from the spirit of the invention or scope of the subjoined claims.

What is claimed is:

1. An improved handbow comprising:

(a) a frame;

(b) a handle extending laterally from the frame when the frame is in an upright position;

(c) an opening in the frame through which an arrow may be supported and shot;

(d) an elastic bowstring secured at its opposite ends to the frame;

(e) a pair of spaced stops extending rearwardly of the frame for terminating the forward movement of the bowstring to provide a uniform application of force to an arrow upon its release from the bowstring the stops being disposed substantially vertical when the frame is in the upright position; and (f) one of the stops including means for engaging the arm of an archer to stabilize the handbow during shooting.

2. The handbow of claim 1 wherein each stop terminates in a free end having a cup-shaped recess for contacting the bowstring.

3. The handbow of claim 2 wherein each recess includes a substantially flat bottom, with both bottoms being substantially coplanar.

4. The handbow of claim 2 wherein the stops both extend rearwardly a sufficient distance to secure the bowstring in its relaxed state within the recesses without stretching the bowstring.

5. The handbow of claim 1 wherein the handle includes:

(a) a first grip for grasping by the index finger of an archer; and (b) a second grip for grasping by the thumb of an archer.

6. The handbow of claim 1 wherein:

(a) the frame includes a pair of slots disposed at each of two opposed ends; and (b) the opposite ends of the bowstring are each secured in a pair of the slots.

7. The handbow of claim 1 wherein the opening has a closed perimeter of substantially rectangular configuration.

8. The handbow of claim 1 further including a sight disposed within the opening and capable of both vertical and horizontal adjustment.

9. The handbow of claim 1 wherein the opening includes means for supporting the arrow during aiming and shooting.

10. The handbow of claim 1 wherein the frame and handle are integrally molded of plastic material.

11. The handbow of claim 1 wherein the frame and handle are integrally formed of aluminum.

12. The handbow of claim 1 wherein the frame and handle are integrally formed of wood.

* * * * *